US008881955B2

(12) United States Patent
Strobel-Schmidt et al.

(10) Patent No.: US 8,881,955 B2
(45) Date of Patent: Nov. 11, 2014

(54) EXTRUSION DEVICE

(75) Inventors: Rainer Strobel-Schmidt, Bad Woerishofen (DE); Christian Hefele, Breitenbrunn (DE); Peter Ostermeier, Diessen (DE); Hans Peter Lederle, Durach (DE)

(73) Assignee: Hilti Aktiengesellschaft, Schaan (LI)

( * ) Notice: Subject to any disclaimer, the term of this patent is extended or adjusted under 35 U.S.C. 154(b) by 283 days.

(21) Appl. No.: 12/806,970

(22) Filed: Aug. 25, 2010

(65) Prior Publication Data

US 2011/0056997 A1 Mar. 10, 2011

(30) Foreign Application Priority Data

Sep. 9, 2009 (DE) ..... 10 2009 040 695

(51) Int. Cl.
*B05C 17/005* (2006.01)
*B05C 17/015* (2006.01)
*B05C 17/01* (2006.01)

(52) U.S. Cl.
CPC ..... *B05C 17/0052* (2013.01); *B05C 17/015* (2013.01); *B05C 17/0126* (2013.01); *B05C 17/00553* (2013.01)
USPC ..... 222/391; 222/326; 222/136; 222/137; 222/342; 222/148; 15/104.04; 15/256.5

(58) Field of Classification Search
USPC ..... 222/148, 342, 391, 326, 327, 136, 137; 15/104.04, 220.4, 256.5
See application file for complete search history.

(56) References Cited

U.S. PATENT DOCUMENTS

| | | | | |
|---|---|---|---|---|
| 4,264,021 | A * | 4/1981 | Davis, Jr. | 222/326 |
| 4,461,407 | A | 7/1984 | Finnegan | 222/391 |
| 4,923,096 | A | 5/1990 | Ennis, III | |
| 5,191,672 | A * | 3/1993 | Boston et al. | 15/256.5 |
| 5,295,614 | A * | 3/1994 | Chang | 222/137 |
| 5,329,664 | A * | 7/1994 | Boston et al. | 15/256.5 |
| 6,349,857 | B1 * | 2/2002 | Lepsius et al. | 222/391 |

FOREIGN PATENT DOCUMENTS

DE 198 45 685 4/2000

* cited by examiner

*Primary Examiner* — Kevin P Shaver
*Assistant Examiner* — Nicholas J Weiss
(74) *Attorney, Agent, or Firm* — Davidson, Davidson & Kappel, LLC

(57) ABSTRACT

An extrusion device for compound-containing containers, including a receiving chamber for the container, a piston rod which is displaceable relative to the receiving chamber and further including an extrusion mechanism having an advancing mechanism for advancing the piston rod. A wiper element is provided which has a wiper edge facing the piston rod.

20 Claims, 2 Drawing Sheets

EXTRUSION DEVICE

This claims the benefit of German Patent Application DE 10 2009 040 695.6, filed Sep. 9, 2009 and hereby incorporated by reference herein.

The present invention relates to an extrusion device for compound-containing containers.

BACKGROUND

Such an extrusion device is used for dispensing compounds which are packaged in containers, such as mortar and sealing compounds, at a site of application. The containers include, for example, cartridges having one or more receiving chambers for one or more components of the compound to be dispensed which are provided directly or packaged, e.g. in foil bags, in the receiving chambers of the cartridge. The term "container" further includes foil bags which are filled with one or more components of the compound to be dispensed and which are inserted in a separate receiving body or in a receiving body mounted on the extrusion device.

When actuating the extrusion mechanism, an advancing mechanism acts on the at least one piston rod, advancing it by a predetermined amount. For example, a pressure piston attached to the piston rod acts on the compound contained in the container so that each time the piston rod is advanced, a corresponding amount of the compound is dispensed through a dispensing opening.

The extrusion mechanism may be operated mechanically (for example, using a trigger), electrically, or by a fluid (e.g., compressed air or hydraulic oil).

U.S. Pat. No. 4,461,407 describes an extrusion device for compound-containing containers, having a piston rod which is displaceable relative to the receiving chamber, and further having an extrusion mechanism including an advancing mechanism for advancing the piston rod.

The drawback of the known approach is that contaminants adhering to the piston rod, such as mortar remainders, may enter the advancing mechanism as the piston rod is advanced or retracted. Such contaminants or dirt may damage or even destroy the advancing mechanism. This reduces the life of the extrusion device.

SUMMARY OF THE INVENTION

It is an object of the present invention to provide an extrusion device for compound-containing containers that will overcome the aforementioned disadvantages and provide increased usability over the known extrusion device.

In accordance with the present invention, there is provided at least one wiper element having at least one wiper edge facing the at least one piston rod.

During advance or retraction of the at least one piston rod, dirt or contaminants adhering thereto are removed by the at least one wiper element, thereby preventing them from entering the advancing mechanism and impairing the extrusion operation. Advantageously, the at least one wiper element is made of a metal or plastic material having suitable properties for this application. Advantageously, the preferably sharp-edged wiper edge of the at least one wiper element is slightly spaced apart from the at least one piston rod so that the wiper edge is not permanently in contact with the respective piston rod. This prevents unwanted wear of the piston rod. Since the advancing mechanism is now better protected and exposed to less wear as compared to the advancing mechanisms of conventional extrusion devices, the life of the extrusion device of the present invention is significantly increased. Advantageously, the at least one wiper element is a separate element which is provided in addition to the other elements and components of the extrusion device.

The advancing mechanism includes a drive or drive means which cooperate with the piston rod and may be actuated by mechanical, electrical, or fluidic means. The drive means includes, for example, a clamping member which serves as an advancing element and can be actuated by a trigger device to advance the at least one piston rod. Alternatively, the drive means includes a drive wheel, such as a friction wheel or a toothed wheel, which may be set into rotation, for example by a motor, to advance the at least one piston rod via the extrusion mechanism. If the drive wheel is driven by a motor, advantageously, a gear mechanism, such as, for example, a planetary gear mechanism, is provided in the drive train between the motor and the drive wheel.

Preferably, the wiper edge of the at least one wiper element extends around a substantial portion of the cross-sectional circumference of the at least one piston rod, so that a large part of the dirt adhering to the at least one piston rod is removed as the at least one piston rod is advanced or retracted. The wiper edge of the at least one wiper element may, for example, completely surround the cross-sectional circumference of the at least one piston rod. If the piston rod has a polygonal, for example, rectangular cross section, the wiper edge of the at least one wiper element surrounds the cross section of the piston rod on at least two, advantageously three sides. In the case of a piston rod having a polygonal cross section, the wiper edge is formed in the wiper element, for example, by a U-shaped cut-out which is open toward an edge of the wiper element, or by a polygonal cut-out which is circumferentially enclosed and is advantageously similar to the polygonal cross-sectional shape of the at least one piston rod.

Preferably, the at least one piston rod is provided with a toothing on at least one side, and the at least one wiper element is provided with a cut-out in the wiper edge facing the toothing. In the course of time, burrs form on the toothing (e.g., a toothing formed by elevations and depressions, or holes provided in the piston rod for engagement of the drive means of the advancing mechanism). The cut-out in the wiper edge of the at least one wiper element prevents mechanical sticking at the location of the at least one wiper element, thus avoiding impairment of the extrusion operation, even when there is a burr on the at least one piston rod.

Preferably, a housing is provided for accommodating at least a portion of the advancing mechanism, the housing including at least one housing wall having a through hole for the at least one piston rod, and the at least one wiper element being provided at the at least one housing wall. Due to this arrangement of the at least one wiper element, dirt can advantageously be prevented from entering the housing and thus the advancing mechanism of the extrusion mechanism, and the at least one wiper element can be easily mounted on the extrusion device. The at least one wiper element may be provided directly on the at least one housing wall or at a distance therefrom.

Preferably, the housing has at least two opposite housing walls defining a receiving chamber for at least a portion of the advancing mechanism, each of the housing walls having a through hole for the at least one piston rod. Thus, the receiving chamber for the advancing mechanism is bounded on two sides with respect to the longitudinal extent of the at least one piston rod. Advantageously, the at least one wiper element is provided on the extrusion device according to the highest expected accumulation of dirt.

Preferably, the at least one wiper element is provided on the side of the at least one housing wall that is opposite to the advancing mechanism, so that dirt adhering to the at least one piston rod is removed outside of the receiving chamber; i.e., outside of the advancing mechanism, as the at least one piston rod is advanced or retracted.

In addition or alternatively, the at least one wiper element is provided on the side of the at least one housing wall that faces the advancing mechanism, so that dirt adhering to the at least one piston rod is removed within the receiving chamber; i.e., adjacent the advancing mechanism, as the at least one piston rod is advanced or retracted.

Preferably, at least two wiper elements are provided for the at least one piston rod, each of said at least two wiper elements having at least one wiper edge facing the at least one piston rod. Thus, dirt adhering to the at least one piston rod is removed therefrom at least two spaced apart locations as the at least one piston rod is advanced or retracted.

Preferably, at least one opening is provided in the housing for removal of contaminants from the housing. Contaminants, such as mortar remainders, which may be present inside the housing can be easily removed therefrom, and are then no longer able to damage the advancing mechanism. In particular, when a perforated piston rod is used, dirt is also present in the holes and is expelled therefrom when elements of the drive means, such as the teeth of a toothed wheel, enter the holes. If the dirt removed or expelled from the at least one piston rod remained in the receiving chamber of the housing, such dirt could damage the advancing mechanism and/or hinder the extrusion operation. Alternatively, a chamber for receiving the removed or expelled dirt is provided within the housing and can be emptied as needed.

BRIEF DESCRIPTION OF THE DRAWINGS

The present invention is explained in greater detail below with reference to exemplary embodiments. In the drawing.

DETAILED DESCRIPTION

Figure 1:
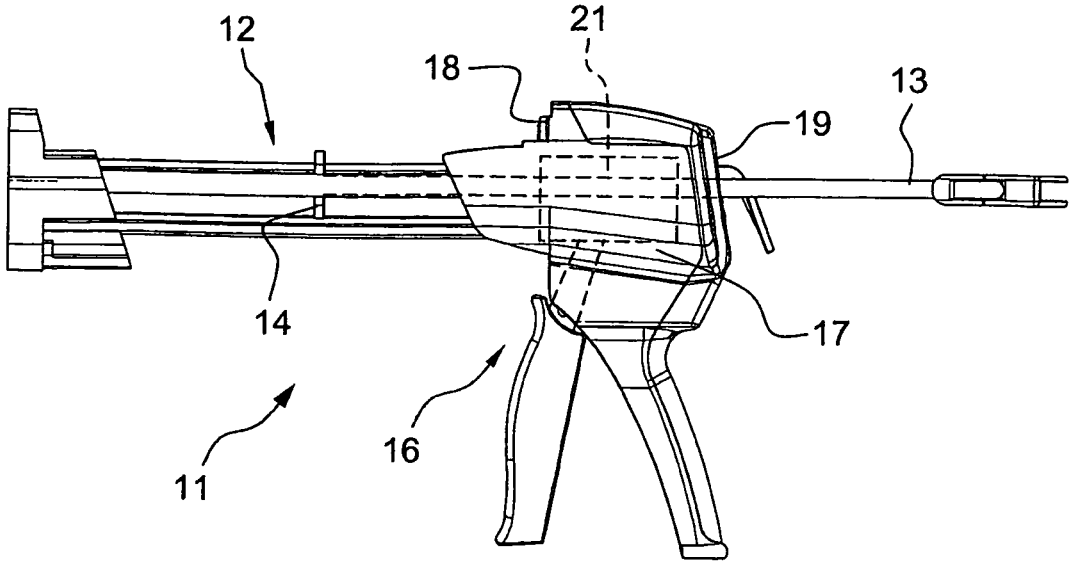
FIG. 1 is a side view of an extrusion device.

In the drawings, like reference numerals are used to indicate like parts throughout the various views.

Figure 2:
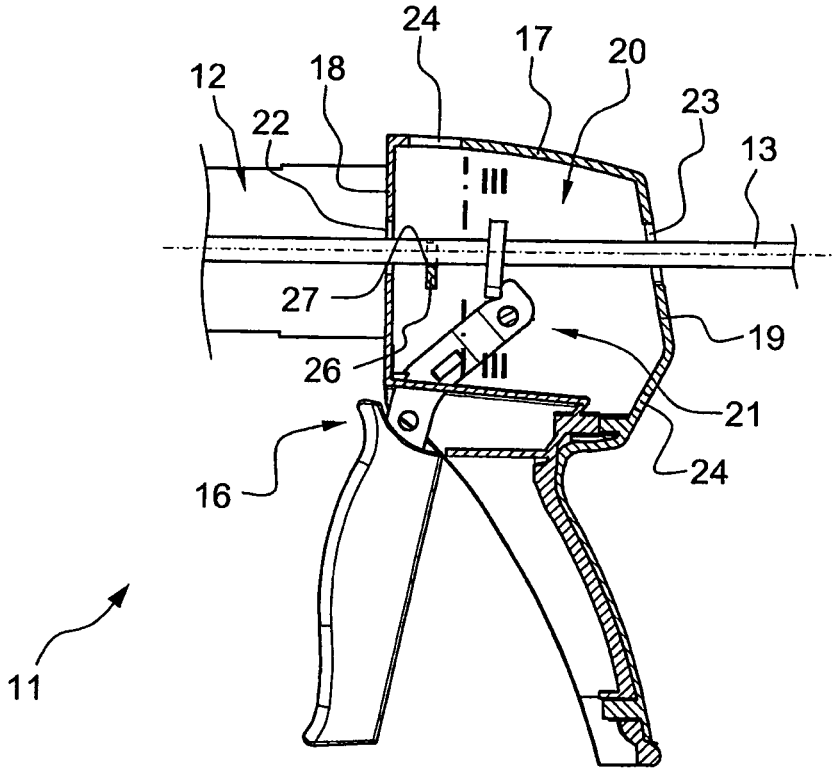
FIG. 2 is a partial section through the extrusion device, taken in a plane parallel to the longitudinal extent of the piston rod.
Figure 3:
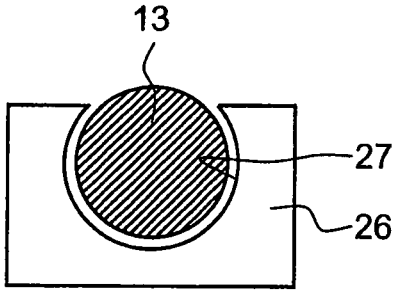
FIG. 3 is an elevation view of the wiper element, taken along line lll-lll of FIG. 2.

Extrusion device 11 for compound-containing containers, as shown in FIGS. 1 through 3, has a receiving chamber 12 for the container, a piston rod 13 which is displaceable relative to the receiving chamber 12, and a mechanically actuatable extrusion mechanism 16. A pressure piston 14 for applying pressure to the container is provided on the end of piston rod 13 facing receiving chamber 12.

Extrusion device 11 further has a housing 17 having two opposite housing walls 18 and 19 defining a receiving chamber 20 for at least a portion of an advancing mechanism 21 of extrusion mechanism 16. Housing walls 18 and 19 each have a through hole 22 or 23 for piston rod 13.

A wiper element 26 having a wiper edge 27 is provided within housing 17 and extends around a substantial portion of the cross-sectional circumference of piston rod 13. Advantageously, wiper edge 27 is sharp. In this exemplary embodiment, the wiper edge extends around an angle of approximately 270°. Housing 17 is further provided with a plurality of openings 24 for removal of contaminants from housing 17.

Figure 4:
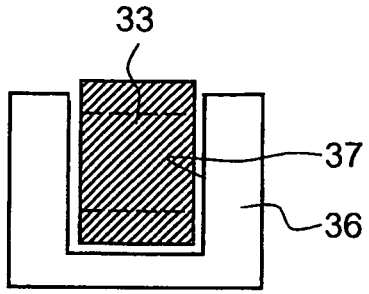
FIG. 4 is an elevation view of a second exemplary embodiment of a wiper element.

FIG. 4 shows a piston rod 33 in the form of a perforated gear rack of rectangular cross-section, and a wiper element 36 which has a wiper edge 37 surrounding the cross-section of piston rod 33 on three sides. Wiper edge 37 is formed by a U-shaped cut-out in wiper element 36 which is open toward a lateral edge.

Figure 5:
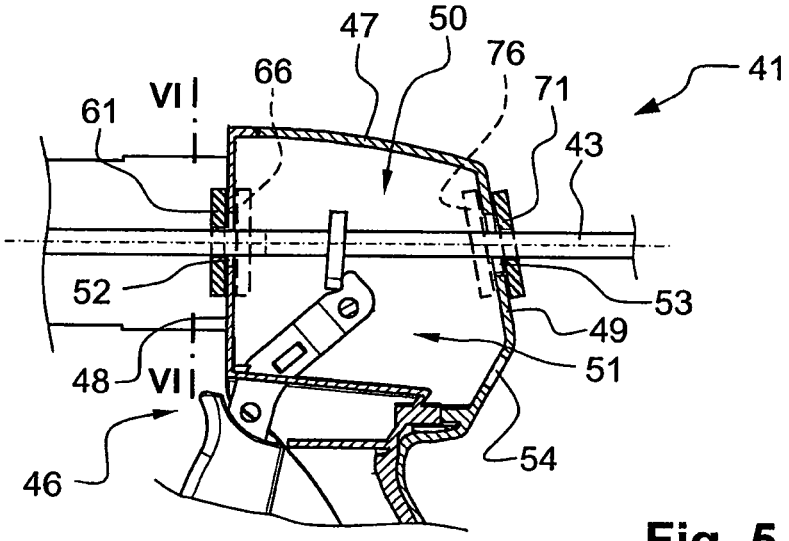
FIG. 5 is a partial section through a further exemplary embodiment of an extrusion device, taken in a plane parallel to the longitudinal extent of the piston rod.
Figure 6:
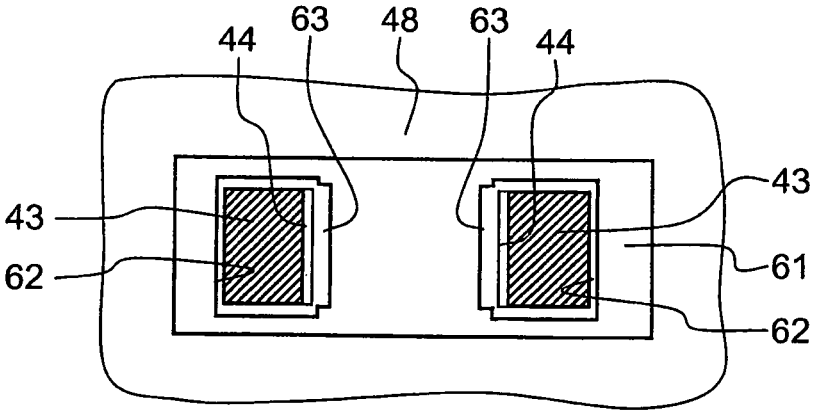
FIG. 6 is an elevation view of the wiper element, taken along line VI-VI of FIG. 5.

FIGS. 5 and 6 are partial cross-sectional views showing an extrusion device 41 which includes two piston rods 43 and a housing 47 having two having two opposite housing walls 48 and 49. Housing walls 48 and 49 define a receiving chamber 50 for at least a portion of advancing mechanism 51 of extrusion mechanism 46, and each have two through holes 52 or 53 for piston rods 43. Housing 47 is further provided with a plurality of openings 54 for removal of contaminants from housing 47.

A wiper element 61 is provided on housing wall 48 on the side of housing wall 48 that is opposite to advancing mechanism 51. Additionally, a further wiper element 66 may be provided on the side of housing wall 48 that faces receiving chamber 50 and advancing mechanism 51. This further wiper element is shown here by a dashed line and may have the same configuration as wiper element 61 located on the outside. Wiper element(s) 61 and/or 66 is/are disposed adjacent through holes 52 for piston rods 43. In this embodiment, wiper element(s) 61 and/or 66 is/are disposed directly on housing wall 48, but may also be disposed at a distance therefrom.

Piston rods 43 are each provided with a toothing 44 on their mutually facing sides. The portions of the advantageously sharp-edged wiper edges 62 that face a toothing 44 are each provided with a cut-out 63.

Moreover, a wiper element 71 is provided on housing wall 49 on the side of housing wall 49 that is opposite to receiving chamber 50 and advancing mechanism 51. Advantageously, wiper element 71 has the same configuration as wiper element 61 on housing wall 48. Additionally, a further wiper element 76 may be provided on the side of housing wall 49 that faces receiving chamber 50 and advancing mechanism 51. This further wiper element is shown here by a dashed line and may have the same configuration as wiper element 71 located on the outside on housing wall 49 or wiper element 66 located on the inside on the housing wall 48. Wiper element(s) 71 and/or 76 is/are disposed adjacent through holes 53 for piston rods 43. In this embodiment, wiper element(s) 71 and/or 76 is/are disposed directly on housing wall 49, but may also be disposed at a distance therefrom.

What is claimed is:

1. An extrusion device for compound-containing containers, comprising:

a receiving chamber for a container;

at least one piston rod displaceable relative to the receiving chamber;

an extrusion mechanism including an advancing mechanism for advancing the at least one piston rod; and at least one wiper element having at least one wiper edge facing the at least one piston rod, the at least one piston rod being provided with a toothing on at least one side, and the at least one wiper element being provided with a cut out portion of the at least one wiper edge facing the toothing, the wiper element being spaced from the toothing at the cut out portion.

2. The extrusion device as recited in claim 1 wherein the wiper edge of the at least one wiper element extends around a substantial portion of the cross-sectional circumference of the at least one piston rod.

3. The extrusion device as recited in claim 1 wherein the wiper edge is spaced further from the toothing at the cut out portion than the wiper edge is spaced from the piston rod away from the cut out portion.

4. The extrusion device as recited in claim 1 further comprising a housing for accommodating at least a portion of the advancing mechanism, wherein the housing includes at least one housing wall having a through hole for the at least one piston rod, the at least one wiper element being provided at the at least one housing wall.

5. The extrusion device as recited in claim 4 wherein the at least one wiper element is provided on a side of the at least one housing wall opposite to the advancing mechanism.

6. The extrusion device as recited in claim 4 wherein the at least one wiper element is provided on a side of the at least one housing wall facing the advancing mechanism.

7. The extrusion device as recited in claim 1 wherein the at least one wiper element includes at least two wiper elements for the at least one piston rod, each of said at least two wiper elements having at least one wiper edge facing the at least one piston rod.

8. The extrusion device as recited in claim 4 wherein the housing includes at least one opening for removal of contaminants from the housing.

9. The extrusion device as recited in claim 1 wherein the wiper element has four sides and the cut out portion is located on one of the four sides, the cut out portion on the one side being spaced from the at least one piston rod further than the other three sides of the wiper element.

10. The extrusion device as recited in claim 1 wherein the wiper element is made of metal.

11. The extrusion device as recited in claim 1 wherein the wiper element is made of plastic.

12. An extrusion device for compound-containing containers, comprising:

a receiving chamber for a container;

at least one piston rod displaceable relative to the receiving chamber;

an extrusion mechanism including an advancing mechanism for advancing the at least one piston rod; and at least one wiper element having at least one wiper edge facing the at least one piston rod, the wiper edge having a cut out portion and a further portion, the cut out portion being spaced further away from the piston rod than the further portion.

13. The extrusion device as recited in claim 12 wherein the wiper edge of the at least one wiper element extends around a substantial portion of the cross-sectional circumference of the at least one piston rod.

14. The extrusion device as recited in claim 12 wherein the at least one piston rod is provided with a toothing on at least one side, and the at least one wiper element is provided with the cut out portion of the at least one wiper edge facing the toothing.

15. The extrusion device as recited in claim 12 further comprising a housing for accommodating at least a portion of the advancing mechanism, wherein the housing includes at least one housing wall having a through hole for the at least one piston rod, the at least one wiper element being provided at the at least one housing wall.

16. The extrusion device as recited in claim 12 wherein the at least one wiper element includes at least two wiper elements for the at least one piston rod, each of said at least two wiper elements having at least one wiper edge facing the at least one piston rod.

17. The extrusion device as recited in claim 15 wherein the housing includes at least one opening for removal of contaminants from the housing.

18. An extrusion device for compound-containing containers, comprising:

a receiving chamber for a container;

at least one piston rod displaceable relative to the receiving chamber, the piston rod being in the form of a perforated gear rack of rectangular cross section;

an extrusion mechanism including an advancing mechanism for advancing the at least one piston rod; and at least one wiper element having at least one wiper edge with a cut out portion facing the at least one piston rod, the wiper edge having at least one surface parallel to a side of the piston rod.

19. The extrusion device as recited in claim 18 wherein the wiper element is made of metal.

20. The extrusion device as recited in claim 18 wherein the wiper element is made of plastic.

* * * * *